US009585447B1

(12) United States Patent
Rudder et al.

(10) Patent No.: US 9,585,447 B1
(45) Date of Patent: Mar. 7, 2017

(54) REVERSIBLE UMBRELLA

(71) Applicants: Keeon Rudder, Houston, TX (US); David Cossey, Houston, TX (US)

(72) Inventors: Keeon Rudder, Houston, TX (US); David Cossey, Houston, TX (US)

( * ) Notice: Subject to any disclaimer, the term of this patent is extended or adjusted under 35 U.S.C. 154(b) by 0 days.

(21) Appl. No.: 14/333,955

(22) Filed: Jul. 17, 2014

Related U.S. Application Data

(60) Provisional application No. 61/847,140, filed on Jul. 17, 2013.

(51) Int. Cl.
*A45B 19/00* (2006.01)
*A45B 25/02* (2006.01)
*A45B 23/00* (2006.01)

(52) U.S. Cl.
CPC ..... *A45B 19/00* (2013.01); *A45B 23/00* (2013.01); *A45B 25/02* (2013.01)

(58) Field of Classification Search
CPC ... A45B 23/00; A45B 19/00; A45B 2019/008; A45B 25/02
USPC ..... 135/15.1, 20.3, 29–31, 98
See application file for complete search history.

(56) References Cited

U.S. PATENT DOCUMENTS 874,648 A * 12/1907 Wolfe ..... 135/31
2,607,362 A * 8/1952 Evans, Jr. ..... 135/15.1
2,725,066 A * 11/1955 Estes et al. ..... 135/15.1
2,788,792 A 4/1957 Koller
3,419,026 A * 12/1968 Evans, Jr. et al. ..... 135/15.1
4,711,260 A * 12/1987 Wiens et al. ..... 135/16
5,865,200 A 2/1999 Kuang et al.
5,909,746 A 6/1999 Doster et al.
7,484,518 B2 * 2/2009 Brader ..... 135/31
2004/0211451 A1 10/2004 Goh
2007/0169801 A1 * 7/2007 Brader ..... 135/31
2008/0006313 A1 1/2008 Wang
2008/0163907 A1 * 7/2008 Garner ..... 135/15.1
2009/0151760 A1 6/2009 Brader
2012/0006367 A1 * 1/2012 Chang et al. ..... 135/25.41
2014/0130836 A1 * 5/2014 Stochetti ..... 135/20.3

* cited by examiner

*Primary Examiner* — Robert Canfield
(74) *Attorney, Agent, or Firm* — Egbert Law Offices, PLLC

(57) ABSTRACT

A reversible umbrella has a pole, a first handle affixed to a first end of the pole, a second handle affixed to a second end of the pole, and a plurality of ribs extending outwardly of the pole. A canopy is affixed to the ribs. The canopy has a first side facing one direction and a second side facing an opposite direction. The ribs are movable from a first position, wherein the first side of the canopy is in a generally concave configuration with respect to the first handle, to a second position, wherein the first side of the canopy is in a generally convex position with respect to the first handle. The opposing sides of the canopy preferably have different appearances or textures, such that the user can select between two designs to be exposed on the exterior of the umbrella.

17 Claims, 10 Drawing Sheets

REVERSIBLE UMBRELLA

RELATED U.S. APPLICATIONS

The present application claims priority from U.S. Provisional Patent Application Ser. No. 61/847,140, filed on Jul. 17, 2013, and entitled "Reversible Umbrella".

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of umbrellas. More particularly, the present invention relates to collapsible umbrellas. Even more particularly, the present invention relates to a reversible umbrella allowing a user to select between two distinct canopy surfaces.

2. Description of Related Art Including Information Disclosed Under 37 CFR 1.97 and 37 CFR 1.98

A collapsible umbrella is typically composed of a shaft, an upper stationary hub mounted on the top end of the shaft, a sliding hub slidably mounted on the shaft which can move along the shaft in either direction to open or collapse the umbrella, a collapsible frame of radiating spreader ribs which are linked to the upper stationary hub and the sliding hub, and a fabric canopy held on the collapsible frame to serve as a cover against rain or shine. Moreover, a finishing cap is mounted on the top of the upper stationary hub.

Despite the great number of people owning and using an umbrella, relatively little development of umbrella technology has occurred over the years. However, some patents have issued in the past related to umbrellas.

For example, U.S. Pat. No. 5,865,200, issued on Feb. 2, 1999 to Kuang et al., describes a collapsible umbrella with a smooth opening mechanism. The collapsible umbrella includes a stretchable multi-segment shaft having a top end and a bottom end. An upper fixed hub mounted axially on the top end of the shaft, the upper fixed hub being formed with a plurality of alignment slots and a threaded hole. The threaded hole allows a finishing cap of either an inner-threaded type or an outer-threaded type to be mounted thereon. A running hub is slidably mounted on the shaft. A collapsible frame of a plurality of ribs includes a set of upper ribs, a set of inner branch ribs, a set of middle branch ribs, a set of linkage ribs, and a set of outer branch ribs, wherein each of the middle branch ribs is formed with a substantially U-shaped cross section to form a slot and integrally formed with a retaining piece. A fabric canopy is held on the collapsible frame. Elastic means allow the collapsed umbrella to be thereafter expanded in a self-opening manner.

Much of the development, as far patents go, has been directed towards various type of reversible umbrellas. These various developments have attempted to solve problems related wind gusts inverting the umbrella canopy and thus breaking the umbrella mechanism. Further, some reversible umbrellas allow the user to close the umbrella in the manner opposite to how an umbrella is conventionally closed. Closing the umbrella is this manner would be useful to prevent water from soaking the interior of car, for example, when the user of the umbrella enters the vehicle.

U.S. Pat. No. 5,909,746, issued on Jun. 8, 1999 to Doster et al., describes such a reversible umbrella. The umbrella has a canopy, and is supported on a telescopic shaft by articulated ribs that extend from the shaft beneath the canopy. The articulated ribs are connected to auxiliary ribs and both are controlled by guides and stabilizers that extend radially from a reciprocable transfer sleeve on the telescopic shaft and move the ribs and auxiliary ribs to fold the canopy inside out as the transfer sleeve is lowered on the shaft, the shaft is shortened, and the umbrella is closed.

U.S. Pat. No. 2,788,792, issued on Apr. 16, 1957 to Koller, teaches a wind resistant reversible umbrella. The mechanism in the Kollar reversible umbrella appears to allow an inversion of the canopy ribs so as to cause the canopy to be inverted and prevent breakage of the umbrella.

U.S. Pat. No. 874,648, issued on Dec. 24, 1907 to Wolfe, describes another reversible umbrella. As with many of the other prior art patents, the Wolfe patent appears to teach the concept of inverting the canopy of the umbrella.

U.S. Patent Publication No. 2009/0151760, published on Jun. 18, 2009 to Brader, also describes a reversible umbrella. This device includes a supportive pole having an upper portion and a lower portion and a canopy assembly slidably mounted thereon. The canopy assembly further includes first, second, and third sliding collars mounted on the supportive pole. A canopy is attached to canopy support rods, wherein each of the canopy support rods is hingeably attached at one end to the third sliding collar. A first plurality of connector rods are provided, wherein one end of each connector rod is hingeably attached to one of the canopy support rods and wherein the other end of the connector rod is hingeably attached to the second sliding collar. A second plurality of connector rods are also provided, wherein one end of each connector rod is hingeably attached to one of the first plurality of connector rods and wherein the other end is hingeably attached to the first sliding collar.

U.S. Patent Publication No. 2008/0006313, published on Jan. 10, 2008 to Wang, teaches an umbrella structure for retracting various rib in a reverse direction. The stick umbrella structure includes a main shank, a plurality of rib units and a canopy. A fixed hub and a movable slider are mounted on opposite ends of the main shank. The movable slider is slidably provided on the main shank and positioned at two predetermined positions. The rib unit consists of a main rib and a spreader rib. One end of the main rib pivot-connects with the movable slider. One end of the spreader rib pivot-connects with the fixed hub while the other end pivot-connects with a pivot point of the main rib. A center of the canopy is fixed to the fixed hub while an outer periphery of the canopy is fixed to the main ribs. Accordingly, the rib units are capable of unfolding the canopy by spreading the main ribs and the canopy can be folded in a reverse direction by retracting the main ribs.

U.S. Patent Publication No. 2004/0211451, published on Oct. 28, 2004 to Goh, teaches an inverse umbrella. The inverse umbrella has a double canopy structure and an inverse opening system. The double canopy structure comprises an outer canopy and an inner canopy. The inverse opening system comprises a network of ribs and mechanism for moving the ribs so that the inner canopy is on the outside when the umbrella is in the collapsed position. When the inverse umbrella is closed after exposure to rain, the dry inner canopy is on the outside, thereby preventing undesirable dripping. The inverse umbrella also includes a sleeve and water collection system that encloses the rain dampened umbrella so that water adhering to the canopy can be properly collected in a unidirectional water-retaining device without making the surroundings wet when the user carries around the rain dampened umbrella. The water collection system comprises a one-way flow check valve that directs water droplets from the wet outer canopy toward a water reservoir while preventing the collected water from flowing out of the reservoir.

While the prior art describes a number of reversible umbrellas, none of these can actually be used when the canopy is in the reversed or inverted position. As such, it is a primary object of the present invention to provide a reversible umbrella wherein the umbrella may be used when the canopy is in the reversed or inverted position.

It is an object of the present invention to provide a reversible umbrella having a two handles.

It is an object of the present invention to provide a reversible umbrella wherein the user can choose which side of the canopy to expose on the upper side of the reversible umbrella.

It is another object of the present invention to provide a reversible umbrella which achieves aesthetic advances over the prior art.

It is another object of the present invention to provide a reversible umbrella which is relatively strong and wind resistant.

It is another object of the present invention to provide a reversible umbrella which is relatively inexpensive and easy to manufacture.

These and other objects and advantages of the present invention will become apparent from a reading of the attached specification.

BRIEF SUMMARY OF THE INVENTION

The present invention is a reversible umbrella having a pole, a first handle affixed to a first end of the pole, a second handle affixed to a second end of the pole, a plurality of ribs extending outwardly of the pole, and a canopy affixed to the plurality of ribs. The canopy has a first side facing one direction and a second side facing an opposite direction. The plurality of ribs are moveable from a first position wherein the first side of the canopy is in a generally concave configuration with respect to the first handle to a second position wherein the first side of the canopy is in a generally convex configuration with respect to the first handle.

In a preferred embodiment the umbrella has a sleeve with an interior, the pole slidably received in the interior of the pole. In this embodiment, the second handle is positioned adjacent the sleeve when the plurality of ribs are in the first position, and the first handle is positioned adjacent the sleeve when the plurality of ribs are in the second position. The sleeve preferably has a first stopper and a second stopper. A first slider is releasably engageable with first stopper, and a second slider is releasably engageable with second stopper.

In the present invention, the plurality of ribs includes a first set of spreader ribs, a second set of spreader ribs and a set of main ribs. A first slider is movable along a length of the pole, the first set of spreader ribs being pivotally connected to the first slider. A second slider is movable along the length of said pole, the second set of spreader ribs being pivotally connected to the second slider. A hub is also positioned on the pole, the set of main ribs being pivotally connected to the hub.

In the present invention, a plurality of pivot connections are provided wherein respective ribs of the first and second sets of spreader ribs the set of main ribs intersect at a location remote from the pole.

In one embodiment of the present invention, the pole includes a first pole telescopically connected to the first handle, and a second pole telescopically connected to the second handle. In this embodiment, the plurality of ribs includes a first set of spreader ribs, a second set of spreader ribs, and a set of main ribs. A stationary hub is provided, and the first pole is affixed to a first end of stationary hub, and the second pole is affixed to a second end of the stationary hub. The set of main ribs are connected to said stationary hub. A first sliding hub is movable along the first pole, and the first set of spreader ribs are connected to the first sliding hub. A second sliding hub is movable along the second pole, and the second set of spreader ribs are connected to the first sliding hub. At least one lock may be positioned along the first pole and second pole, the at least one lock being suitable for engaging at least one of the first handle, the second handle, the first sliding hub and the second sliding hub.

In the present invention, the first pole is preferably in an extended configuration and the second pole in a retracted position when the plurality of ribs are in the first position, the second pole being in an extended configuration and the first pole being in a retracted position when the plurality of ribs are in the second position.

In the present invention, the first handle is in a position away from the canopy and the second side of the canopy is in a convex configuration suitable for protecting a user from the elements when the plurality of ribs are in the first position.

Preferably, the first side of the canopy is a first sheet of material, and the second side of the canopy is second sheet of material having a different appearance or texture than that of the first sheet of material.

The foregoing Section is intended to describe, in generality, the preferred embodiment of the present invention. It is understood that modifications to this preferred embodiment can be made within the scope of the present invention. As such, this Section should not to be construed, in any way, as limiting of the scope of the present invention. The present invention should only be limited by the following claims and their legal equivalents.

DETAILED DESCRIPTION OF THE INVENTION

Figure 1A:
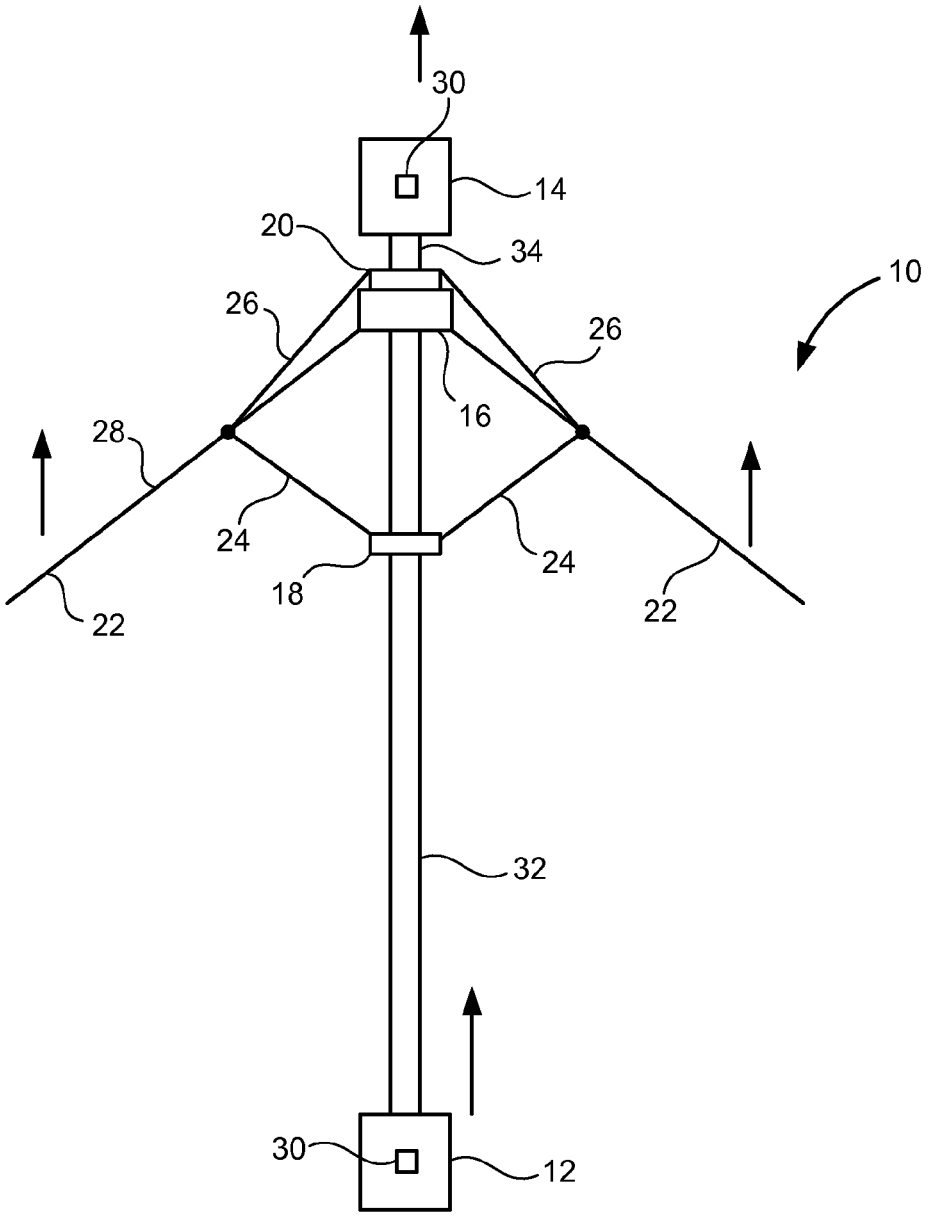
FIG. 1A is a side view of the reversible umbrella of the present invention in a first opened position.

Referring to FIG. 1A, there is shown a side view of the reversible umbrella 10 of the present invention. In FIG. 1A, the umbrella is in a first opened position. The reversible umbrella 10 has a first handle 12 and a second handle 14. The first handle 12 is affixed to the first telescoping pole 32, while the second handle 14 is affixed to the second telescoping pole 34. A stationary hub 16 is positioned at the junction of the first telescoping pole 32 and the second telescoping pole 34.

A first slider 18 is movably positioned on the first telescoping pole 32 between the first handle 12 and the stationary hub 16. The first slider 18 can be locked in place, in the manner shown in subsequent figures. The first slider 18 is affixed to a first set of spreader ribs 24. The first set of spreader ribs 24 are pivotally attached to the first slider 18. The first set of spreader ribs 24 are movably affixed along the main ribs 22, such that the effective length of the spreader ribs can be changed depending on the position of the umbrella.

Adjacent the second handle 14 is a second slider 20. Similar to the first slider 18, the second slider 20 is connected to a second set of spreader ribs 26, which are also connected to the main ribs 22. The canopy 28 of the umbrella is positioned along the main ribs 22. The canopy 28 can be a first canopy on the first side of the main ribs 22 and a second canopy on a second side of the main ribs 22. Preferably, the opposite sides of the canopy can be of different designs or colors.

Also shown in FIG. 1A are buttons 30 positioned on the first handle 12 and the second handle 14. The buttons can be used to control the opening and closing of the umbrella through the mechanisms described in subsequent figures.

Figure 1B:
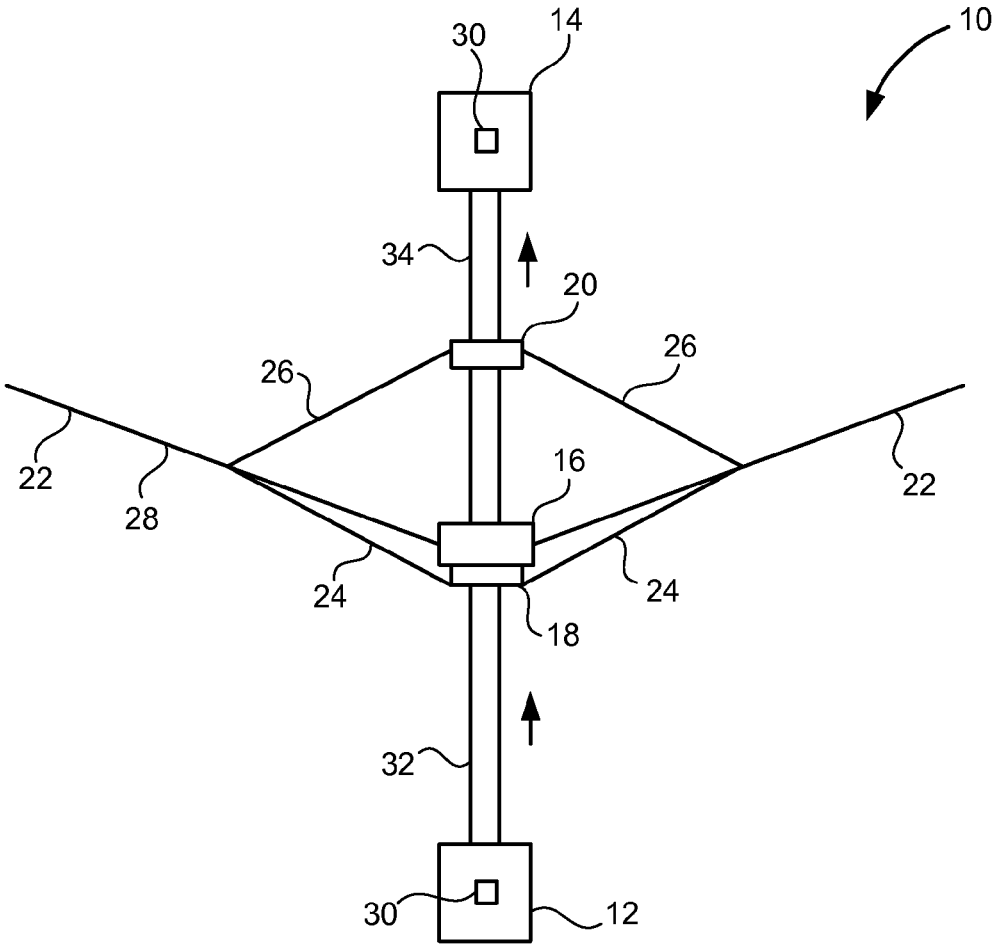
FIG. 1B is a side view of the reversible umbrella of the present invention in an intermediate, transitional position.

FIG. 1B shows the reversible umbrella 10 in an intermediate position between the first and second positions. In FIG. 1B, it can be seen how the first handle 12 is being telescoped upwardly toward the stationary hub 16. Similarly, the first slider 18 is being moved so as to be adjacent the stationary hub 16. The first set of spreader ribs 24 pivot relative to the first slider 18 and also slide along the main ribs 22 so as to accommodate the movement of the slider 18.

In FIG. 1B, it can be seen how the second handle 14 is being telescoped outwardly of the stationary hub 16, and the second slider 20 is being moved away from the stationary hub 16. Referring back to FIG. 1A, it can be seen how the second slider 20 was positioned adjacent the stationary hub 16 when the umbrella 10 was in the first position.

Figure 1C:
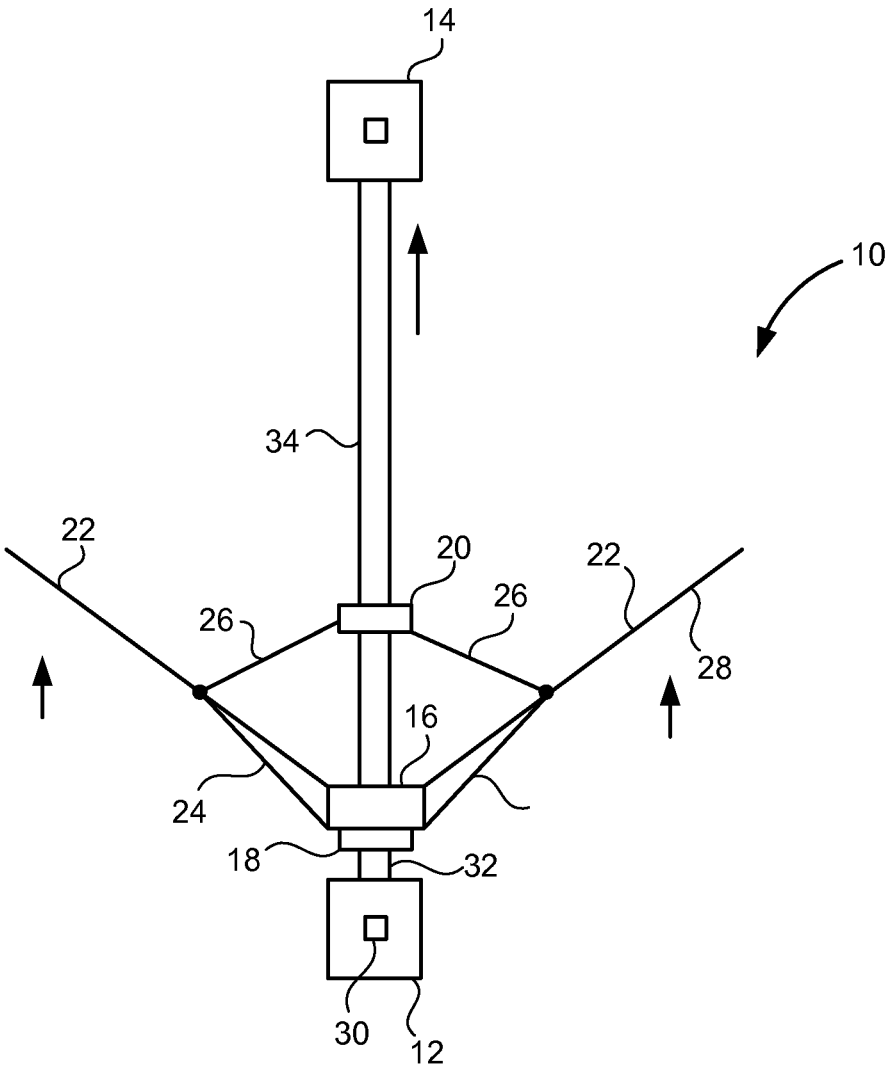
FIG. 1C is side view of the reversible umbrella of the present invention in a second opened position.

FIG. 1C shows the reversible umbrella 10 in the second opened position. The second handle 14 is fully telescoped outwardly of the stationary hub 16. The second slider 20 is also positioned away from the stationary hub 16. At the same time, the first handle 12 is positioned adjacent the stationary hub 16 with the first slider 18 being positioned therebetween. In this second position, it can be seen how the first handle 12 serves as a cap for the umbrella 10. The second handle 14 would serve as the cap in the first opened position shown in FIG. 1A. In this second position, an opposite side of the canopy 28 would now be exposed to the elements.

Figure 2:
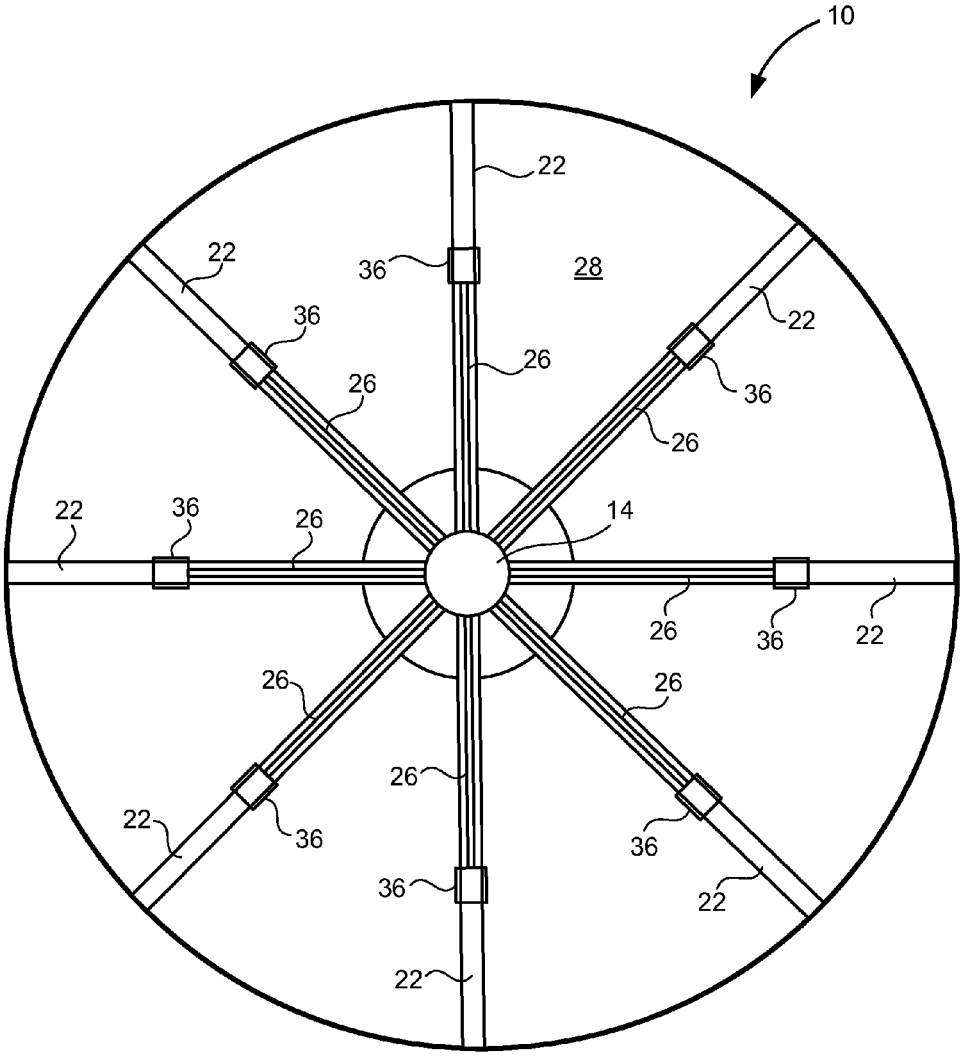
FIG. 2 is top view of the reversible umbrella of the present invention, wherein the reversible umbrella is in the first opened position shown in FIG. 1A.

Referring to FIG. 2, there is shown a top view of the reversible umbrella 10 of the present invention, the umbrella 10 being in the first opened position. The top view of the reversible umbrella 10 shows the umbrella 10 having eight main ribs 22 and eight spreader ribs 26. From the top view, one can see how the second handle 14 now serves as a cap for the reversible umbrella 10. The second set of spreader ribs 26 are exposed at the top side of the umbrella 10. The respective spreader ribs 26 converge at the second slider (not shown here) and are movably affixed to main ribs 22 at opposite ends thereof. The rib hub boxes 36 receive the main ribs and slide thereon. The rib hub boxes 36 also receive the spreader ribs 24 and 26. Within the concept of the present invention, the reversible umbrella 10 could include a greater or lesser number of main and spreader ribs.

Figure 3:
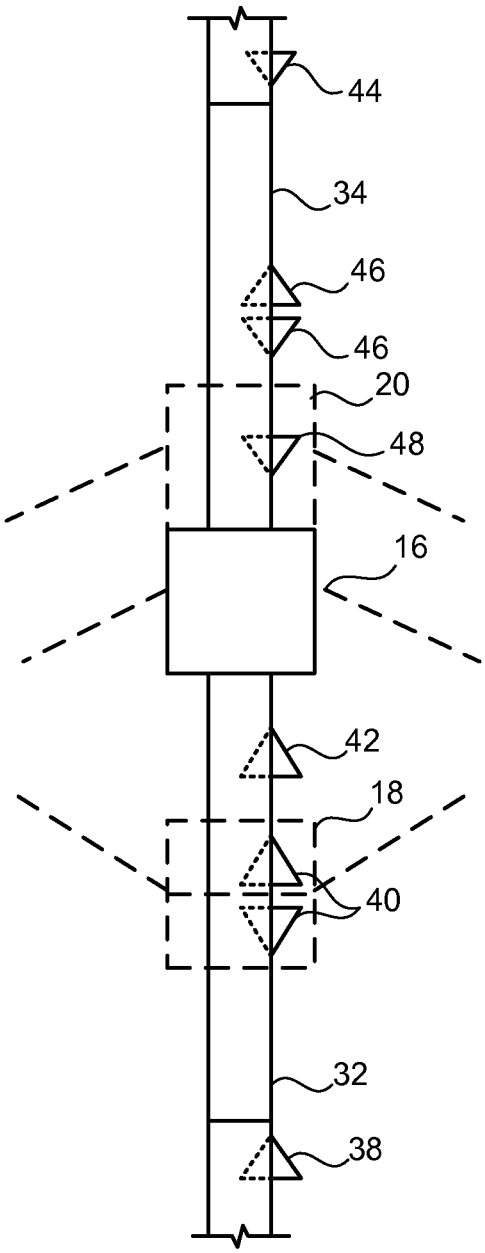
FIG. 3 is an isolated view of the telescoping poles of the present invention wherein the various locks are visible.

FIG. 3 shows an isolated view of the first and second telescoping poles 32 and 34 and the various locks provided thereon. The various locks are positioned so as to secure the first and second handles 12 and 14, and first and second sliders 18 and 20 in a desired position. In FIG. 3, these sliders are positioned as they would be when the umbrella is in the first opened position as shown in FIG. 1A. Starting from the bottom of the figure, the first telescoping pole 32 has a first lock 38. The first lock 38 of the first telescoping pole 32 is used to control the telescoping aspect of the first telescoping pole 32. Above the first lock 38 is the second lock 40. The second lock 40 of the first telescoping pole 32 is preferably a two-sided lock. The first slider is shown as being locked in place by the second lock 40 of the first telescoping pole 32. A protrusion or catch within the first slider 18 is received between the two portions of the second lock 40. Above the second lock 40 is the third lock 42 of the first telescoping pole 32. The first slider 18 would be positioned on the third lock 42 of the first telescoping pole 32 when the reversible umbrella 10 is in the second opened position.

The second telescoping pole 34 similarly has a first lock 44, a set of second locks 46 and a third lock 44. In FIG. 3, the second slider 20 is shown as being positioned over and secured by the third lock 48 of the second telescoping pole 34 adjacent the stationary hub 16. Broken lines show the general direction of the various spreader and main ribs as extending from the sliders 18 and 20 and the stationary hub 16.

Each of the various locks is shown as extending outwardly from the respective poles, while the dotted lines adjacent the various locks shown an indentation into which the locks can be pushed. The various locks can be manually operated or be connected to the various buttons of the reversible umbrella 10. FIG. 3 shows a preferred embodiment of the locking system of the present invention. However, various other locking means and arrangements are envisioned by the inventor.

Figure 4:
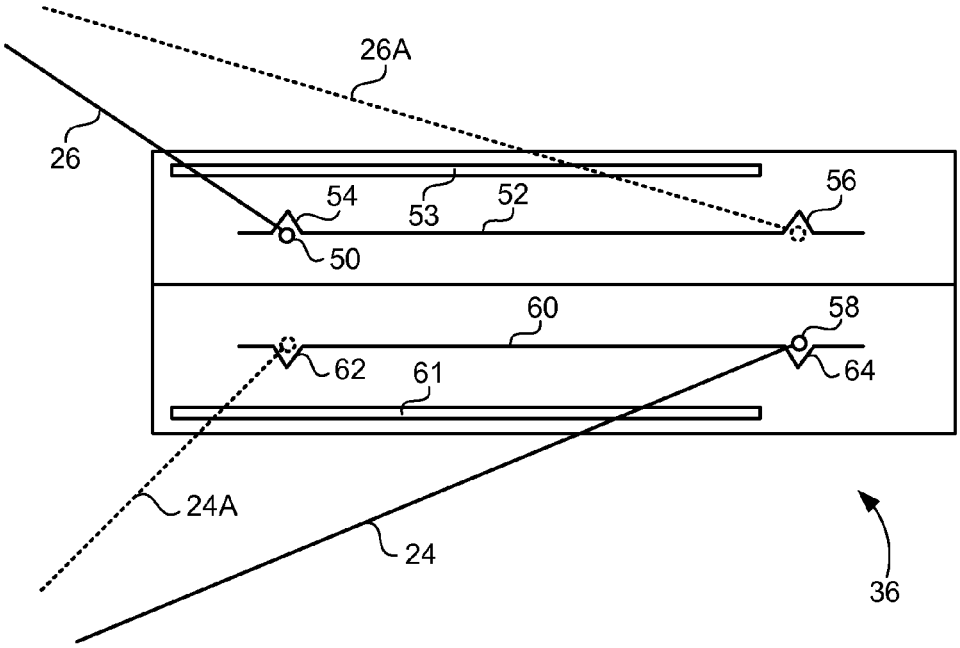
FIG. 4 is an isolated schematic view of the intersection of the spreader ribs and main ribs showing how the spreader ribs slide along the main ribs.

FIG. 4 shows an isolated, schematic view of a preferred embodiment of the intersection 36 of the spreader ribs and main ribs. One of the first set of spreader ribs 24 is shown as having a tee 58 positioned at an end thereof. The tee 58 extends perpendicular to the spreader rib 24. The tee 58 of the first set of spreader ribs 24 is slidable along a path 60 between a first indentation 62 and a second indentation 64. The indentations temporarily secure or lock the tee 58 of the first spreader rib 24 in place.

Similarly, each of the second spreader ribs 26 has a tee 50 at an end thereof. The tee 50 of the second spreader rib is movable along a path 52 between a first indentation 54 and a second indentation 56. Within the concept of the present invention, there could be a greater number of indentations along the paths 52 and 60.

Figure 4A:
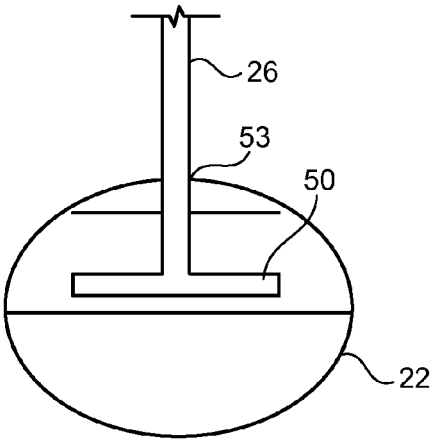
FIG. 4A shows an isolated view of the tee of a spreader rib positioned within the main rib.

The first spreader rib 24 extends into the interior of the main rib 22 through the channel 61. The channel 61 extends along the main rib 22 along the path 60. Similarly, the second spreader rib 26 extends into the interior of the main rib 22 through the channel 53. FIG. 4A is a detailed view showing how the tee 50 of the second spreader rib 26 fits within the main rib 22, the spreader rib 26 extending through channel 53. The arrangement of the first spreader rib 24 is identical.

Lines 24*a* and 26*a* show the spreader ribs 24 and 26 as having been moved to indentations 64 and 56, respectively.

FIG. 4 shows the first and second spreader ribs 24 and 26 as they would be positioned when the reversible umbrella 10 is in the first opened position. Having the multiple indentations allows for the spreader ribs to have different effective length as required by the position of the reversible umbrella 10. Other means for allowing the spreader ribs to slide along the main ribs could be used as an alternative.

The use of the opposing sets of spreader ribs 24 and 26 allows for greater strength against wind gusts. In the first opened position, the spreader ribs 26 would provide a downward force upon the main ribs 22 so as to prevent inversion of the umbrella. Should the gusts be strong enough, the reversible umbrella 10 of the present invention would likely not break because the mechanism is set up such that it can actually be reversed.

The reversible umbrella 10 also allows for aesthetic advantages over prior art umbrellas. For example, opposing sides of the canopy 28 could be different colors or designs. The simple reversal of the umbrella would allow a user to switch between a first color or design and a second color and design. While the prior art umbrellas could be considered reversible in one sense of the word, the present invention is truly reversible and can be used when the canopy is in the inverted or reversed position.

Figure 5A:
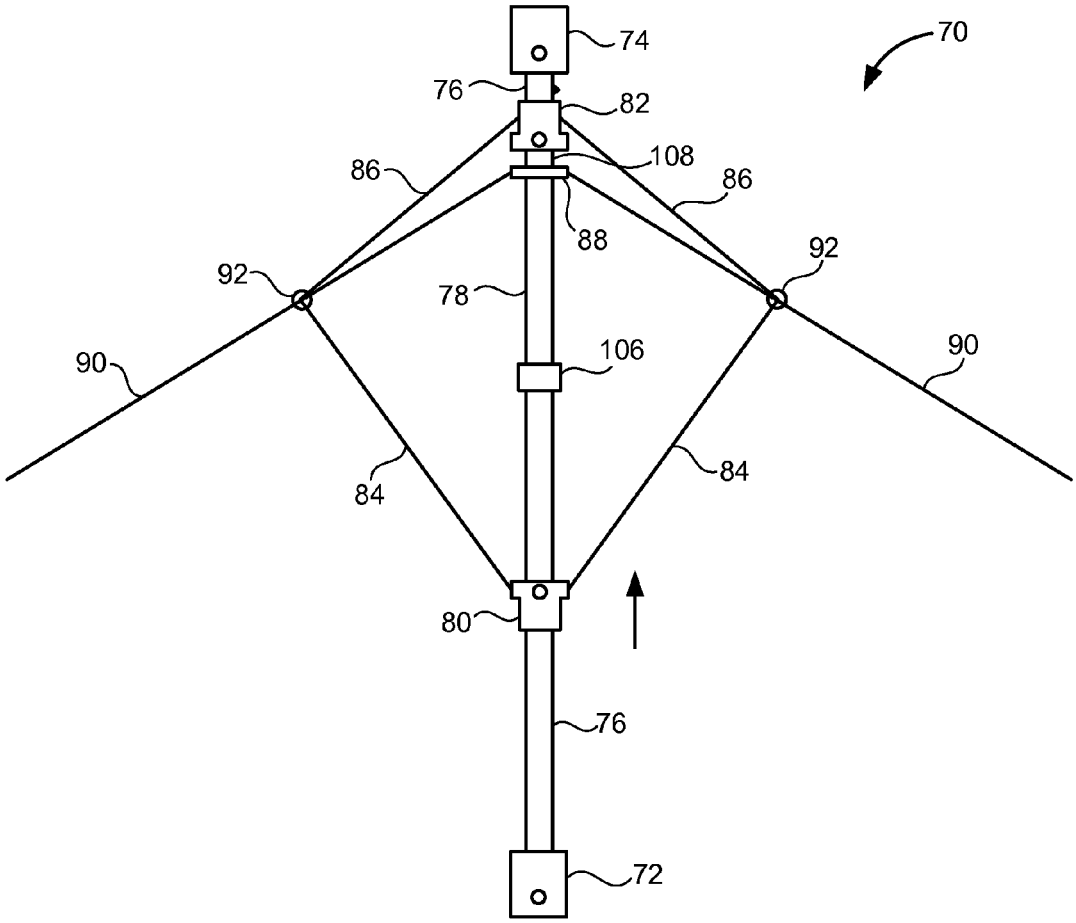
FIG. 5A is a side view of the reversible umbrella of the preferred embodiment of the present invention as it is being opened to a first position.
Figure 5B:
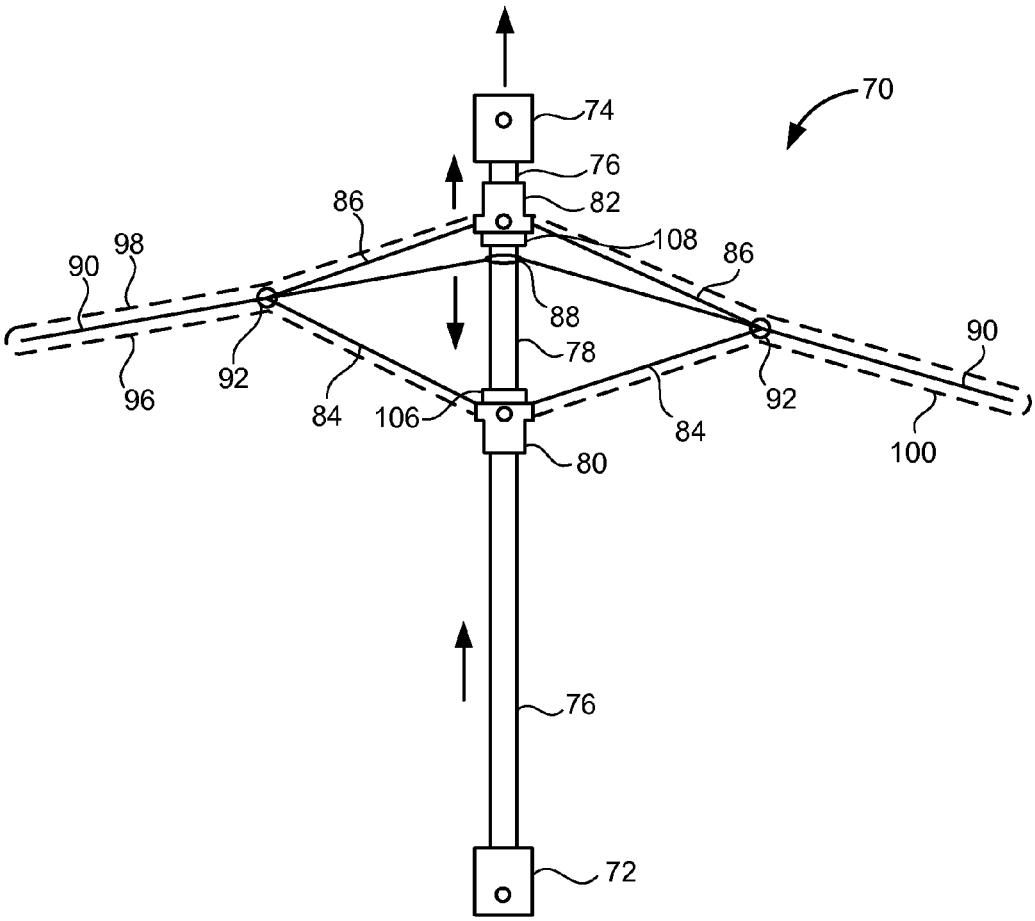
FIG. 5B is a side view of the reversible umbrella of the preferred embodiment the present invention in the first open position.
Figure 5C:
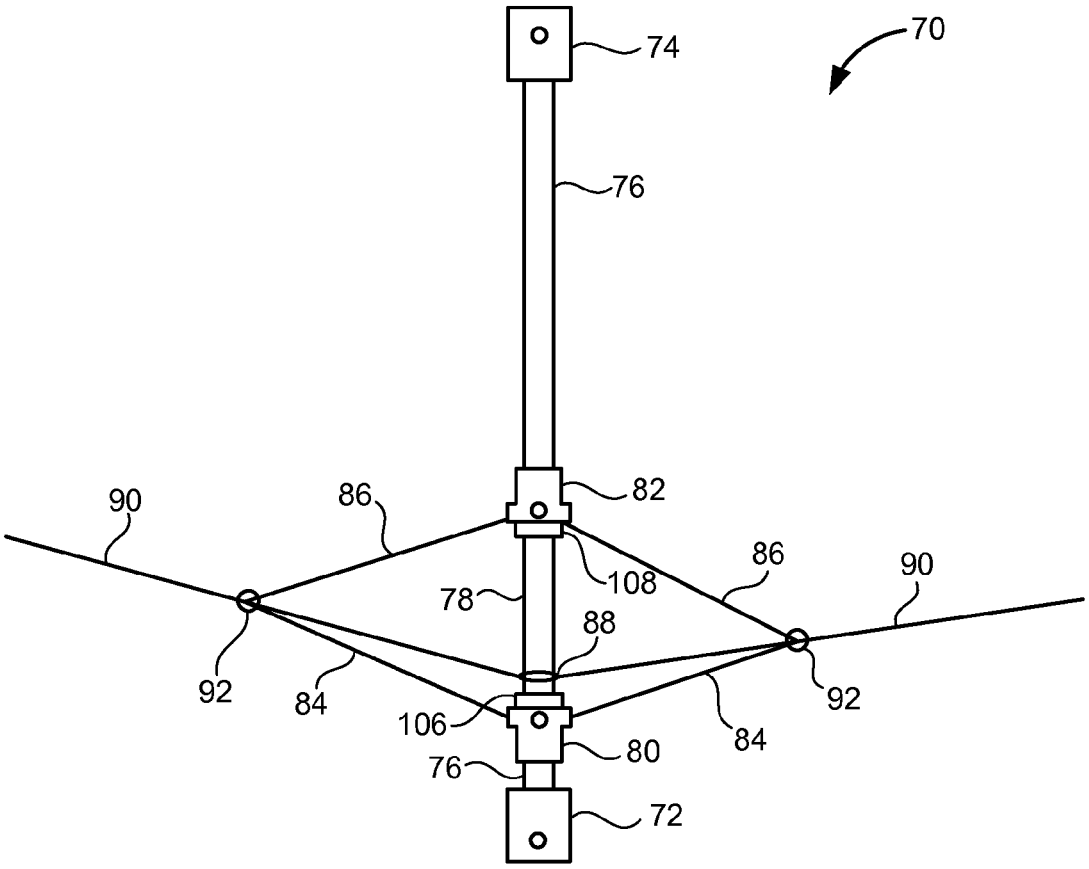
FIG. 5C is a side view of the reversible umbrella of the preferred embodiment of the present invention in the second opened position.

FIGS. 5A-5C show the reversible umbrella of the preferred embodiment of the present invention. In FIG. 5, it can be seen that there is a reversible umbrella 70 having a first handle 72 opposite a second handle 74. The first and second handles 72 and 74 are connected to opposite ends of a single pole 76. This single pole 76 is used in lieu of the pair of the telescoping poles described in previous figures.

In the preferred embodiment of the present invention, there is also a sleeve 78. The sleeve 78 has an interior through which the pole 76 passes. As such, the sleeve 78 has a diameter slightly greater than that of the pole 76. As the pole 76 is slidable within the sleeve 78, this allows for the pole to be positioned such that either the first handle 72 or second handle 74 can be used without requiring the telescoping aspect of the poles shown in the previous figures. The use of the single pole leads to less moving parts in the preferred embodiment of the present invention, and also makes for easier usage of the reversible umbrella 70 and decreased likelihood of the poles jamming.

Also shown in FIGS. 5A-5C are first slider 80 and second slider 82. The first slider 80 is movably positioned along the pole 76 between the first handle 72 and the sleeve 78. The first slider 80 is connected to a first set of spreader ribs 84. In FIGS. 5A-5C, only two spreader ribs are shown in the first set of spreader ribs. However, more spreader ribs are used, preferably as shown in FIG. 2. The second slider 82 is positioned along the pole between the second handle 74 and the sleeve 78. The second slider 82 is connected to the second set of spreader ribs 86.

A pair of stoppers 106 and 108 are affixed to the ends of the sleeve 78. The first slider 80 is releasably engageable with the stopper 106, while the second slider 82 is releasably engageable with the stopper 18.

Figure 6:
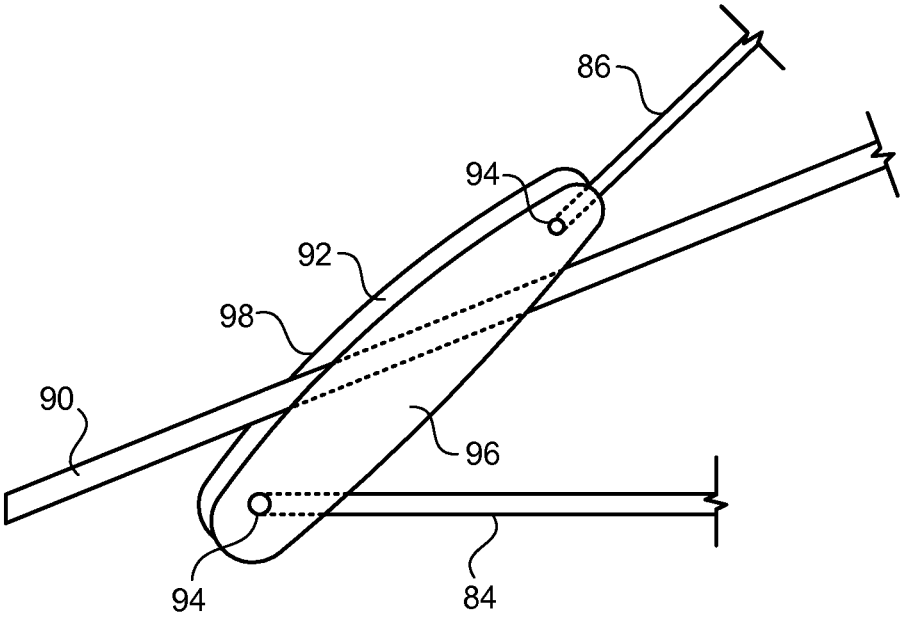
FIG. 6 is an isolated view of a pivot connection of the reversible umbrella of the preferred embodiment of the present invention.

The main ribs of 90 are connected to a sliding hub 88, which slides along the sleeve 78. The main ribs 90, first set of spreader ribs 84 and second set of spreader ribs 86 intersect at pivot connections 92, the details of which are shown in FIG. 6.

Also shown in FIG. 5B is the umbrella canopy 100. The canopy 100 is presented in broken lines and extends around the various ribs 84, 86 and 90. Preferably, the canopy 100 is composed of two sheets comprising opposing sides 96 and 98. Preferably, the opposing sides 96 and 98 have different properties, such as appearance and texture.

FIG. 5A shows the reversible umbrella 70 opening to a first position wherein the first handle 72 is utilized. FIG. 5B shows the reversible umbrella opened fully to the first position. In this first position, the lower side 96 of the canopy is in a generally concave configuration with respect to the first handle 72. The opposing side 98 is facing upwardly so as to protect the user from the elements. FIG. 5B shows arrows indicating the directions in which the various parts would move so as to move the reversible umbrella 70 from the first position to the second position.

FIG. 5C shows the reversible umbrella 70 fully in the second open position. In FIG. 5C, it can be seen how the second handle 74 is extended away from the sleeve 78, while the first handle 72 has been moved adjacent the sleeve 78. As such, the umbrella 70 has been fully inverted so as to utilize the opposite side of the canopy 100. The pole 76 has been slid through the sleeve 78 so as to position the handles properly for the use of the umbrella 70 in the second position. Various buttons are provided on the handles and sliders so as to allow for the releasable engagement of the sliders with the stoppers, and the pole with the sleeve.

Referring to FIG. 6, there shown a pivot connection 92. As can be seen in FIG. 6, the main ribs 90 extends through the interior of the two-sided pivot connection 92. The rib from the second set of spreader ribs 86 is pivotally connected to the pivot connection 92 at pin 94. Similarly, the rib from first of spreader ribs 84 is pivotally connected to the pivot connection 92 at another pin 94. The rib from the set of main ribs 90 is relatively free to move within the interior of the pivot connection 92. This unique pivot connection allows for the reversible umbrella 70 the present invention to be utilized in either of the first and second open positions.

Figure 7:
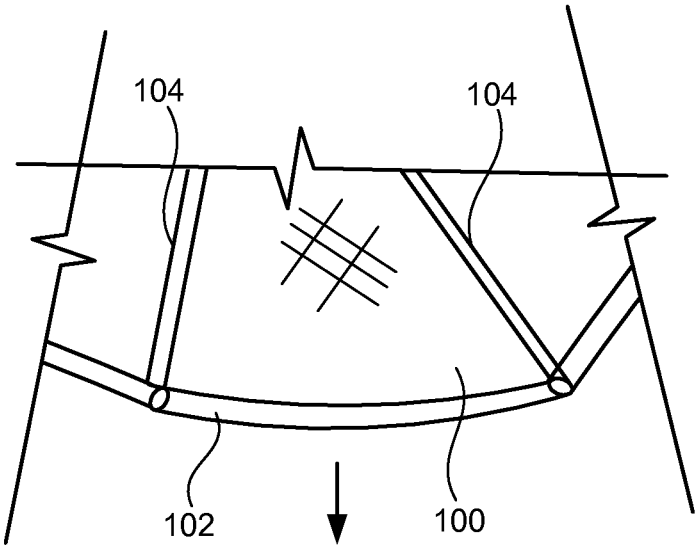
FIG. 7 is an isolated view showing a weighted hem on the canopy of the reversible umbrella the present invention.

FIG. 7 shows an isolated view of the canopy 100 in one embodiment of the present invention. In this embodiment the present invention, the canopy 100 has a weighted hem 102. The weighted hem 102 extends around the perimeter of the canopy 100 and biases the canopy in a downward direction, which is extremely useful in the reversible umbrella of the present invention. The ribs 104 are also shown as extending through the canopy 100 to an area adjacent the weighted hem 102.

The foregoing disclosure and description of the invention is illustrative and explanatory thereof. Various changes in the details of the described method can be made within the scope of the present claims without departing from the true spirit of the invention. The present invention should only be limited by the following claims and their legal equivalents.

We claim:

1. A reversible umbrella comprising:
a pole;
a first handle affixed to a first end of said pole;
a second handle affixed to a second end of said pole;
a plurality of ribs extending outwardly of said pole, said plurality of ribs comprising:
a first set of spreader ribs extending outwardly of said pole;
a second set of spreader ribs extending outwardly of said pole; and
a set of main ribs extending outwardly of said pole;
a canopy affixed to said plurality of ribs, said canopy having a first side facing one direction and a second side facing an opposite direction, said plurality of ribs moveable from a first position wherein said first side of said canopy is in a generally concave configuration with respect to said first handle to a second position wherein said first side of said canopy is in a generally convex configuration with respect to said first handle; and
a plurality of pivot connections, wherein respective ribs of said first set of spreader ribs and said second set of spreader ribs and said set of main ribs intersect at a pivot connection of said plurality of pivot connections at a location remote from said pole.

2. The reversible umbrella of claim 1, further comprising:
a sleeve having an interior, said pole slidably received in said interior of said sleeve, said second handle being positioned adjacent said sleeve when said plurality of ribs are in said first position, said first handle being positioned adjacent said sleeve when said plurality of ribs are in said second position.

3. The reversible umbrella of claim 1, further comprising:
a first slider movable along a length of said pole, said first set of spreader ribs being pivotally connected to said first slider;
a second slider movable along said length of said pole, said second set of spreader ribs being pivotally connected to said second slider; and
a hub positioned on said pole, said set of main ribs being pivotally connected to said hub.

4. The reversible umbrella of claim 3, further comprising:
a sleeve having an interior, said pole extending through said interior of said sleeve, said hub being movable along a length of said sleeve.

5. The reversible umbrella of claim 4, said sleeve having a first stopper and a second stopper, said first slider being releasably engageable with said first stopper, said second slider being releasably engageable with said second stopper.

6. The reversible umbrella of claim 1, said pole comprising:
a first pole telescopically connected to said first handle; and
a second pole telescopically connected to said second handle.

7. The reversible umbrella of claim 6, further comprising:
a stationary hub, said first pole affixed to a first end of said stationary hub, said second pole affixed to a second end of said stationary hub, said set of main ribs being connected to said stationary hub;
a first sliding hub movable along said first pole, said first set of spreader ribs being connected to said first sliding hub; and
a second sliding hub movable along said second pole, said second set of spreader ribs being connected to said first sliding hub.

8. The reversible umbrella of claim 7, further comprising:
at least one lock positioned along said first pole and said second pole, said at least one lock suitable for engaging at least one of said first handle, said second handle, said first sliding hub and said second sliding hub.

9. The reversible umbrella of claim 1, wherein said first handle is in a position away from said canopy and said second side of said canopy is in a convex configuration suitable for protecting a user from the elements when said plurality of ribs are in said first position.

10. The reversible umbrella of claim 1, said first side of said canopy comprising a first sheet of material, said second side of said canopy comprising a second sheet of material, said second sheet of material of said second side of said canopy having a different appearance or texture than an appearance or texture of said first sheet of material of said first side of said canopy.

11. A reversible umbrella comprising:
a sleeve having an interior;
a pole slidably received in said interior of said sleeve;
a first handle affixed to a first end of said pole;
a second handle affixed to a second end of said pole;
a plurality of ribs extending outwardly of said pole;
a canopy affixed to said plurality of ribs, said canopy having a first side facing a first direction and a second side facing an opposite direction, said plurality of ribs moveable from a first position wherein said first side of said canopy is in a generally concave configuration with respect to said first handle to a second position wherein said first side of said canopy is in a generally convex configuration with respect to said first handle.

12. The reversible umbrella of claim 11, said second handle being positioned adjacent said sleeve when said plurality of ribs are in said first position, said first handle being positioned adjacent said sleeve when said plurality of ribs are in said second position.

13. The reversible umbrella of claim 11, said first side of said canopy comprising a first sheet of material, said second side of said canopy comprising a second sheet of material, said second sheet of material of said second side of said canopy having a different appearance or texture than an appearance or texture of said first sheet of material of said first side of said canopy.

14. The reversible umbrella of claim 11, said plurality of ribs comprising:
a first set of spreader ribs;
a second set of spreader ribs; and
a set of main ribs.

15. The reversible umbrella of claim 14, further comprising:
a hub movably positioned on said sleeve, said set of main ribs being pivotally connected to said hub;
a first slider movably positioned on said pole between said hub and said first handle, said first set of spreader ribs being pivotally connected to said first slider; and
a second slider movably positioned on said pole between said hub and said second handle, said second set of spreader ribs being pivotally connected to said second slider.

16. A reversible umbrella comprising:
a hub;
a first pole telescopically connected to said hub;
a second pole telescopically connected to said hub opposite said first pole;
a first handle affixed to said first pole opposite said hub;
a second handle affixed to said second pole opposite said hub;

a plurality of ribs affixed to said hub and extending outwardly thereof;

a canopy affixed to said plurality of ribs, said canopy having a first side facing one direction and a second side facing an opposite direction, said plurality of ribs moveable from a first position wherein said first side of said canopy is in a generally concave configuration with respect to said first handle to a second position wherein said first side of said canopy is in a generally convex configuration with respect to said first handle.

17. The reversible umbrella of claim 16, said first pole being in an extended configuration and said second pole being in a retracted position when said plurality of ribs are in said first position, said second pole being in an extended configuration and said first pole being in a retracted position when said plurality of ribs are in said second position.

* * * * *